US007028682B1

(12) United States Patent
Hansen

(10) Patent No.: US 7,028,682 B1
(45) Date of Patent: Apr. 18, 2006

(54) SPORTS BALL LAUNCHER

(76) Inventor: Christopher L. Hansen, P.O. Box 4898., Chatsworth, CA (US) 91313

( * ) Notice: Subject to any disclaimer, the term of this patent is extended or adjusted under 35 U.S.C. 154(b) by 0 days.

(21) Appl. No.: 10/955,060

(22) Filed: Oct. 14, 2004

(51) Int. Cl.
*A63B 69/40* (2006.01)
*F41B 7/00* (2006.01)

(52) U.S. Cl. ..... 124/16; 124/37

(58) Field of Classification Search ..... 124/16, 124/37

See application file for complete search history.

(56) References Cited

U.S. PATENT DOCUMENTS 3,856,300 A * 12/1974 Payne ..... 124/16
4,164,928 A * 8/1979 Meares ..... 124/16
5,462,285 A * 10/1995 O'Patka et al. ..... 273/459
5,597,160 A * 1/1997 Mims ..... 124/16
5,800,288 A * 9/1998 Mims ..... 473/417
6,019,096 A * 2/2000 Snyder et al. ..... 124/16
6,843,241 B1 * 1/2005 Newcomer ..... 124/16

* cited by examiner

*Primary Examiner*—John A. Ricci
(74) *Attorney, Agent, or Firm*—J. E. McTaggart

(57) ABSTRACT

A ground-based ball launcher for inflated-ball sports practice provides an impulse that propels the ball upwardly in a trajectory of pre-adjustable angle and velocity so as to obtain a desired maximum height and landing distance offset from the launcher. An optional adjustable time delay gives a player time to move into place and get set for each launching. Launching energy may be provided by a compressed coil spring which can be reloaded by the user with foot-pump action.

20 Claims, 5 Drawing Sheets

SPORTS BALL LAUNCHER

FIELD OF THE INVENTION

The present invention relates to the field of sports equipment and more particularly to a sports ball launcher for use in practice of games that utilize an inflated ball, including basketball, volleyball and soccer.

BACKGROUND OF THE INVENTION

Many basketball players devote substantial time to practice activities, sometimes in groups or pairs, but often alone so that practice is normally limited to aspects of the game that do not require the presence of another person, e.g. dribbling and making hoop shots. Activities such as catching high passes and rebounds and face-off jumping normally require the presence and participation of at least one other person besides the player(s), e.g. a player or coach to throw the ball. Two players practicing face-off jumping require a third person to make a fair toss.

DISCUSSION OF KNOWN ART

U.S. Pat. No. 5,575,482 discloses a SPORTS BALL LAUNCHER for basketballs, powered by elastic propulsion bands and features a two-wheeled cart and a ball-loading trough from which sequential launching can be automatic or manually controlled.

U.S. Pat. No. 4,164,928 discloses a BASKETBALL TOSSING DEVICE that is hand-held and thus is not practical for solitary practice U.S. Pat. No. 221,694 discloses a Spring-Trap for Throwing Target-Balls (volleyballs) vertically, that can be triggered remotely by a trip line.

These and other ball launchers of known art are less than satisfactory for solitary practice: upon initiating the launch manually (including the first launch in an automatic series) the player would not have sufficient time to move into place and get properly set for a jump, therefore satisfactory practice with such launchers would require the presence of another player or assistant to initiate the launching.

OBJECTS OF THE INVENTION

It is an object of the invention to provide a launcher for practicing basketball, or other inflated ball game such as volleyball, that can be controlled by a player in a manner to launch a ball conveniently and consistently without impacting the quality of the practice or the fairness between two players and without requiring the services of an additional person besides the player(s).

It is a further object to arrange for the player(s) to be allowed adequate time to get set in place for a launch.

It is a further object to enable the player to make pre-launch adjustments affecting the trajectory of the ball with regard to maximum height and landing distance offset from the ball launcher.

SUMMARY OF THE INVENTION

The objects of the present invention have been met in a ground-based inflated ball launcher, intended for solitary or one-on-one player sports practice, that provides an impulse of force that launches the ball upwardly in a trajectory of pre-adjustable velocity and angle of vertical inclination so as to obtain a desired maximum height and landing distance offset from the launcher. An adjustable timer allows a player to initiate a launch with enough time delay to then move into place and get set before the actual launch of the ball. In a preferred embodiment, the launch is powered by decompression of a coil spring that becomes compressed for loading by the user foot-pumping a treadle pad.

DETAILED DESCRIPTION

Figure 1:
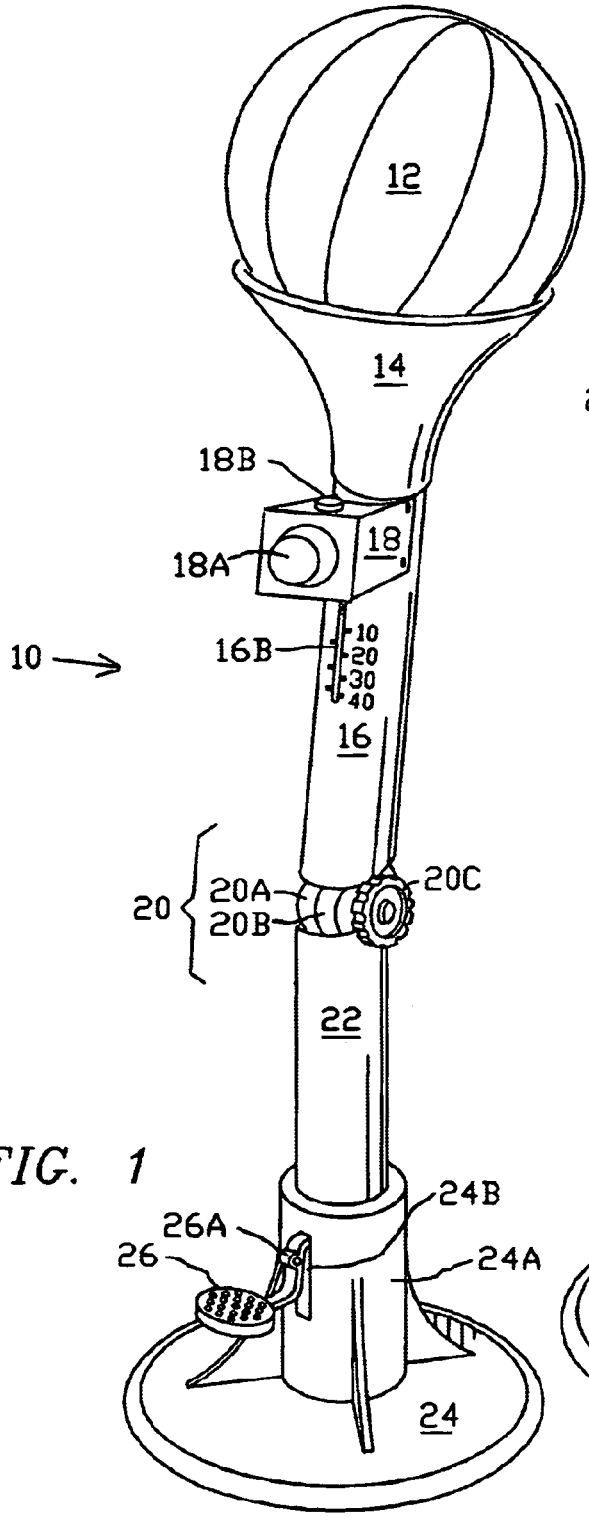
FIG. 1 is a three-dimensional view of a sports ball launcher in accordance with a preferred embodiment of the present invention.

FIG. 1 is a three-dimensional view of an illustrative embodiment of a sports ball launcher 10 in accordance with the present invention. An inflated ball 12, typically a basketball, is supported in a resilient bowl-shaped ball holder 14 extending upwardly from upper tubular member 16.

A timer module 18, attached to tubular member 16 near its upper end, is equipped with a knob 18A for setting a delay time for delayed launch and a pushbutton 18B for triggering an immediate launch.

A hinge joint assembly 20 includes two mating portions: upper portion 20A extending up into the lower end of upper tubular member 16 and lower portion 20B extending down into the upper end of lower tubular member 22. Portions 20A and 20B are seized together firmly by tightening clamp knob 20C, which can be released and re-tightened to reset the inclination of upper tubular member 16 relative to the vertical orientation of lower tubular member 22.

Hinge joint 20 is designed to limit the maximum angle of inclination available so that there is no risk of upsetting the launcher 10 off its base 24.

The lower end of lower tubular member 22 engages hub 24A of a reinforced circular base 24 which is made sufficiently large in diameter, e.g. 14 inches, to provide overall stability of launcher 10.

A treadle pad 26, mounted on an arm that extends through a vertical slot 24B in hub 24A of base 24, enables a user to load the launcher 10 by reciprocating foot-pump action on treadle pad 26. The extending arm is configured with a hinge 26A, located near hub 24A, by which the treadle pad 26 can be folded upwardly when not in use, for purposes of personnel safety.

Figure 2:
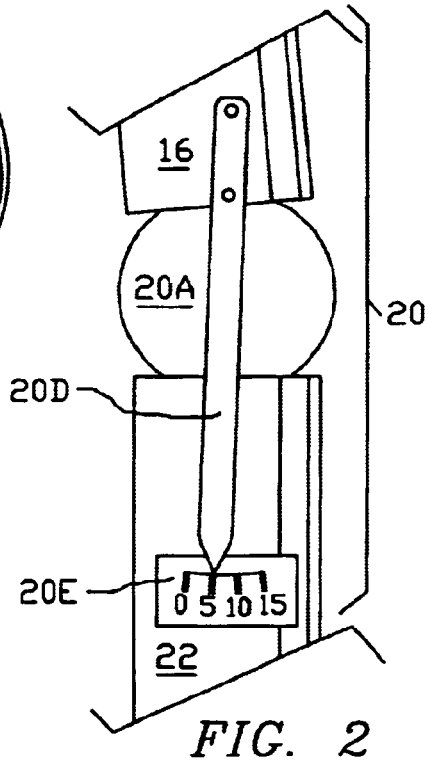
FIG. 2 is an enlarged view of an inclination gage on the left hand side of FIG. 1.

FIG. 2 is an enlarged view of an inclination gage that can be located on the left hand side of hinge joint 20 (FIG. 1). A pointer 20D, affixed to upper tubular member 16, co-operates with a scale 20E on the lower tubular member 22, which may be calibrated in degrees as shown: 0, 5, 10, 15 (degrees), for example.

Figure 3:
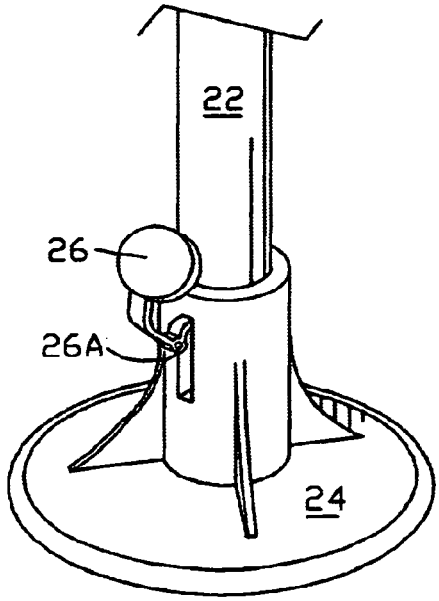
FIG. 3 is a three-dimensional view of a lower portion of the launcher of FIG. 1 showing the treadle pad in its folded standby position.

FIG. 3 depicts the lower portion of FIG. 1 with treadle pad 26 folded upwardly at hinge 26A to a standby location against tubular member 22 for purposes of personnel safety.

Also, for purposes of safety, in addition to making ball-holder 14 and base 24 from resilient material, harder surfaces such as tubular members 16 and 22, and the underside of treadle pad 26 are preferably covered with soft foam material.

Figures 4, 5, 6:
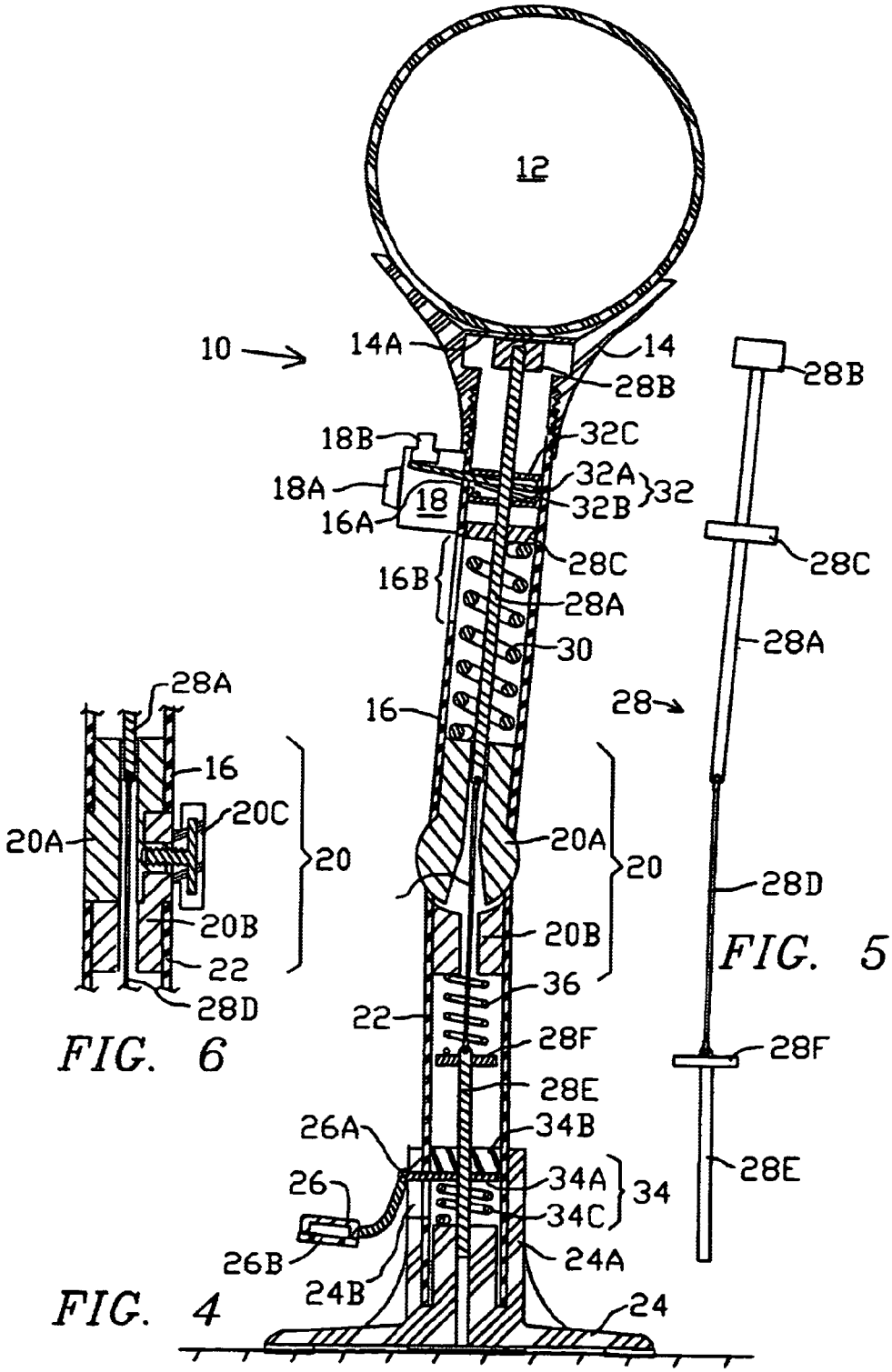
FIG. 4 is a cross-section of the launcher of FIG. 1 taken through a central axis showing a first internal implementation with the launcher in the unloaded condition.
FIG. 5 is a side view of the plunger core assembly of the launcher of FIG. 4.
FIG. 6 is a cross-section of the hinge joint portion of the launcher of FIG. 4, taken in a perpendicular plane.

FIG. 4 is a cross-sectional view of the launcher 10 of FIG. 1, taken through its central axis and through the center of treadle 26, showing a first internal implementation wherein treadle pad 26 is directly coupled to a pumping mechanism located in hub 24A of base 24.

Ball holder 14 is attached to the upper end of tubular member 16, preferably in a threaded manner as shown, and is configured with a resilient circular membrane 14A in the region immediately beneath ball 12, through which the ball 12 is impacted for launching. Membrane 14A serves to keep dirt and debris out of the interior of launcher 10 and to avoid any damage to ball 12 when launched, thus membrane 14A must be made sufficiently durable to withstand repeated launchings yet resilient enough to provide sufficient transfer of energy to the ball 12.

Shown in place in FIG. 4, and also shown separately in FIG. 5 for clarity, a centrally-located plunger core assembly 28, includes an upper plunger rod 28A fitted with a metal striker cap 28B at its upper end, an annular coil drive collar 28C securely fastened to upper plunger core rod 28A in an upper central region thereof as shown, a connection link 28D connected to lower end of upper plunger core rod 28A, a lower plunger core rod 28E connected to the lower end of connection link 28D and an annular recoil spring support collar 28F securely fastened to the upper end of lower plunger core rod 28E as shown in FIG. 4 supporting recoil spring 36. Plunger core rods 28A and 28E are typically made from stainless steel 5/16" in diameter and connection link 28D is preferably made from stainless steel cable about ⅛ inch in diameter, but could be made from steel wire.

The plunger core assembly 28 moves as a whole in a longitudinal, i.e. substantially vertical, work stroke in which vertical movement of rods 28A and 28E (FIG. 4), is controlled by two corresponding unidirectional grip modules 32 and 34.

Unidirectional hold/release module 32 is securely fastened inside tubular member 16 near its upper end. A steel hold/release grip plate 32A is constrained at its right hand end by an overhead fulcrum and is configured at its left hand end with a drive arm that extends into timer 18 through vertical slot 16A configured in the wall of member 16. Grip plate 32A is held in a "floating" manner along with an associated steel coil spring 32B beneath, in a metal shell 32C which is securely fastened to upper tubular member 16.

A main steel coil spring 30 is located within tubular member 16, bearing against coil drive collar 28C at the upper end and supported at the lower end on upper hinge portion 20A, which is configured with a central clearance bore which is dimensioned to guide the lower end of upper plunger rod 28A, and flared to a larger bottom opening to accommodate link 28D for different angles of inclination as set by hinge joint 20.

A central clearance hole in plate 32A is dimensioned for a close clearance fit rod 28A so that when plate 32A is inclined away from perpendicular to rod 28A as shown, urged clockwise by upward bias of spring 32B and fulcrum constraint at the right hand end, the edges of the central clearance hole of plate 32A exert a strong binding friction action on rod 28A that prevents any upward travel of rod 28A. This binding friction action is positively re-enforced: it actually intensifies as the spring 30 become further compressed and the required holding force increases. However, following launching, with the coil holding force removed, plate 32A repositions slightly counterclockwise so as to release the grip on rod 28A and allow the plunger assembly 28 to travel downwardly as required in the re-loading pump strokes.

Recoil spring 36, resting on the top side of coil support collar 28F of rod 28E, with its top end constrained against the bottom end of hinge portion 20B, is relatively weak, serving to stabilize lower plunger rod 28E against overshooting during the launch stroke and ensuring that, after launching, plunger assembly 28 returns to its proper location in the unloaded condition as shown in FIG. 4, avoiding risk of deformation of membrane 14A by strike head 28B.

A unidirectional loading grip module 34, located and securely fastened in the lower end portion of lower tubular member 22 within hub 24A includes a pump grip plate 34A held in the horizontal position shown against the lower side of a solid bulkhead collar 34B by a coil spring 34C which is supported on a portion of base 24. Bulkhead collar 34B is securely fastened to tubular member 22 and is configured with a central clearance hole that guides the upper end of lower rod 28E whose lower end is guided and constrained in a clearance hole configured in base 24 as shown. With pump grip plate 34A located horizontally as shown, its central clearance hole allows lower rod 28E to move freely up or down; however rod 28E is held in the upward location of the plunger core assembly as shown by link 28 due to light force from main coil spring 30 which is at or near in its full length in this unloaded condition, holding upper rod 28A in this upward location via coil drive collar 28C.

The pump drive grip plate 34A extends through a vertical slot 24B configured in hub 24A and in lower tubular portion 22, and is coupled by a hinge joint 26A to treadle pad 26, whose lower side is covered with a foam layer 26B.

FIG. 6 is a cross-section of the region of hinge joint 20 of FIG. 3, taken through a central plane that is perpendicular to that of FIG. 4, as viewed from the left hand side of FIG. 4. The upper hinge joint portion 20A is configured with a hub extending into lower hinge joint portion 20A and having a threaded central opening that engages the threaded shaft of knob 20C, to enable joint 20 to be secured at a desired angle of inclination. The central vertical openings in portions 20A and 20B are seen providing guidance for the lower end of upper rod 28A and clearance for link 28D.

Figures 7, 8, 9:
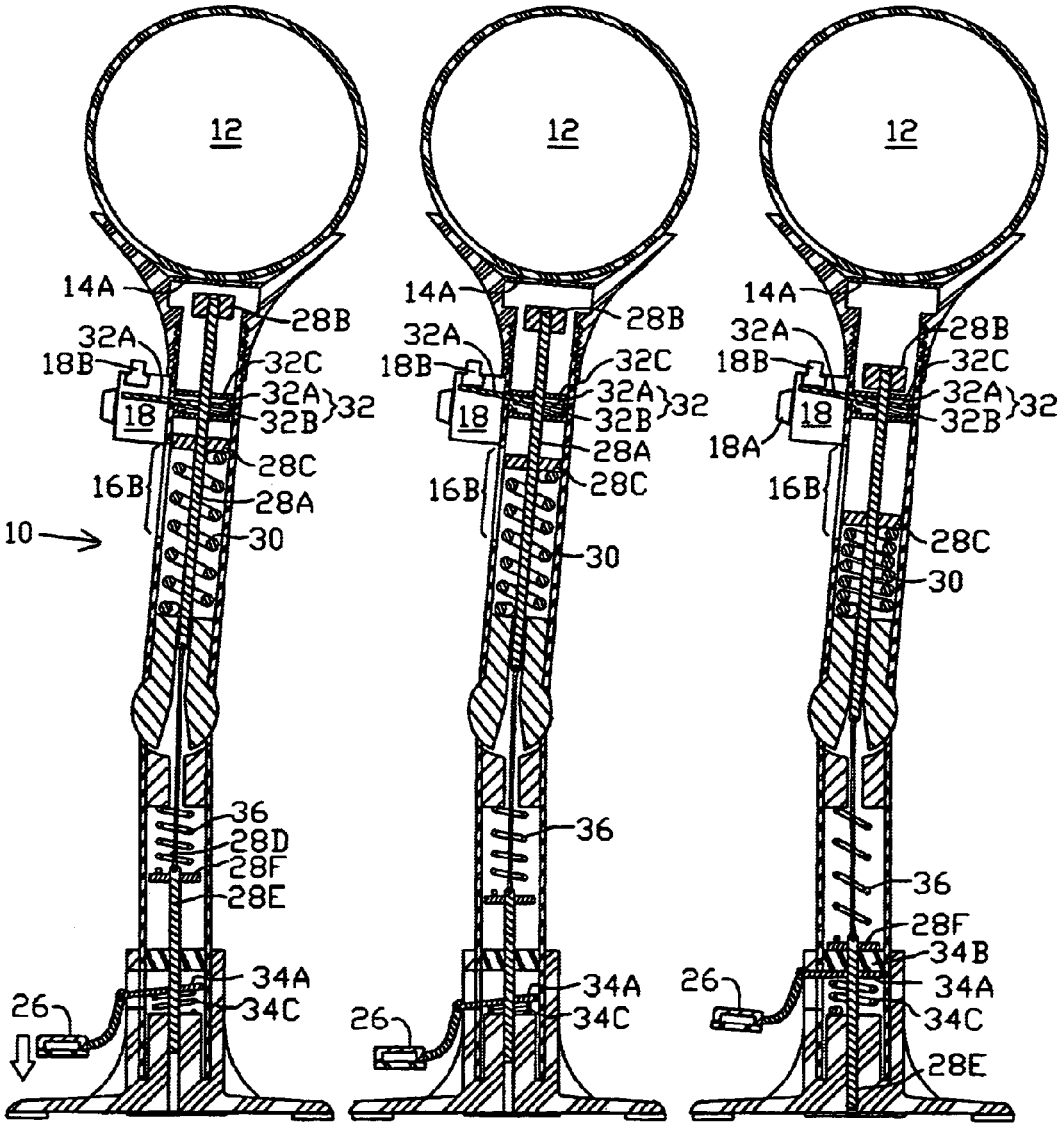
FIGS. 7–9 are cross-sections of the launcher of FIGS. 1 and 4 showing sequential steps in foot-pump loading.

FIGS. 7–9 show cross-sections of launcher 10 in sequential steps of loading launcher 10 by pumping treadle pad 26, following the unloaded starting condition shown in FIG. 4.

FIG. 7 shows treadle pad 26 having been initially depressed as indicated by the arrow, normally by foot by the user, to about half of its full pump stroke length, causing pump grip plate 34A to initially rotate slightly counterclockwise until its central hole grips rod 28E and to then pull the plunger core assembly (28, FIG. 5) downward to the location shown, creating the separation now seen at the top end between membrane 14A and striker cap 28B.

As the plunger core assembly moves downwardly, in the hold/release grip module 32, hold/release grip plate 32A, rotating slightly counterclockwise as shown, indicated by the small separation from pushbutton 18B seen in timer 18, allows the upper rod 28A to move downwardly, pulled down by link 28D in response to downward movement of lower rod 28E as driven by grip plate 34A from foot pressure on treadle pad 26.

FIG. 8 shows treadle pad 26 having been further depressed to the lower end of its pump stroke causing full compression of spring 34C, the plunger core assembly having been pulled down to the further downward location indicated by the increased separation now seen at the top end between membrane 14A and striker cap 28B. At this initial loading condition of launcher 10, i.e. partial compression of main spring 30, the disposition of the plunger assembly is indicated visually to the user by a mark on collar 28C that is visible through vertical slot 16B immediately below timer 18.

When the foot is lifted from treadle 26 for another pump stroke, the treadle 26 and pump grip plate 34A will be automatically returned to their uppermost position (as seen in FIGS. 4 and 9) by the expansive force of spring 34C; however the hold/release grip module 32 will prevent any upward travel of the plunger core assembly as grip plate 32A rotates clockwise to its gripping condition by expansion of spring 32B, gripping onto rod 28A; as seen in timer 18, the extending arm of grip plate 32A has returned to its normal "hold" location immediately beneath pushbutton 18B as in FIGS. 3 and 7. Thus the compression in spring 30 that has occurred in consequence of the first foot pump stroke is retained, and the corresponding potential energy now stored in spring 30 is available for launching.

At this stage, a weak launch could be performed by actuating timer 18 or pushbutton 18A; however, more typically, further pumping will be performed via treadle 26, repeating the pump stroke cycle described above in connection with FIGS. 4, 7 and 8 for as many pump strokes as necessary until a desired load stress in spring 30 has been reached, as indicated by the mark on collar 28C, viewed through vertical slot 16B.

FIG. 9 shows the launcher 10 having been loaded by pumping to its maximum capability with the plunger core assembly pulled down to the lower limit of its travel range and spring 30 fully depressed, as indicated by the mark on collar 28C at the lower end of vertical slot 16B.

After the launcher 10 has been loaded to the desired launch strength, launching is executed by actuating timer 18 or pushbutton 18A: depression of the extending arm of hold/release grip plate 32A releases upper rod 28A and thus releases the plunger core assembly to travel rapidly upward as driven by the force of spring against collar 28C so that drive head 28B launches the ball 12 upwardly by striking membrane 14A.

Figure 10:
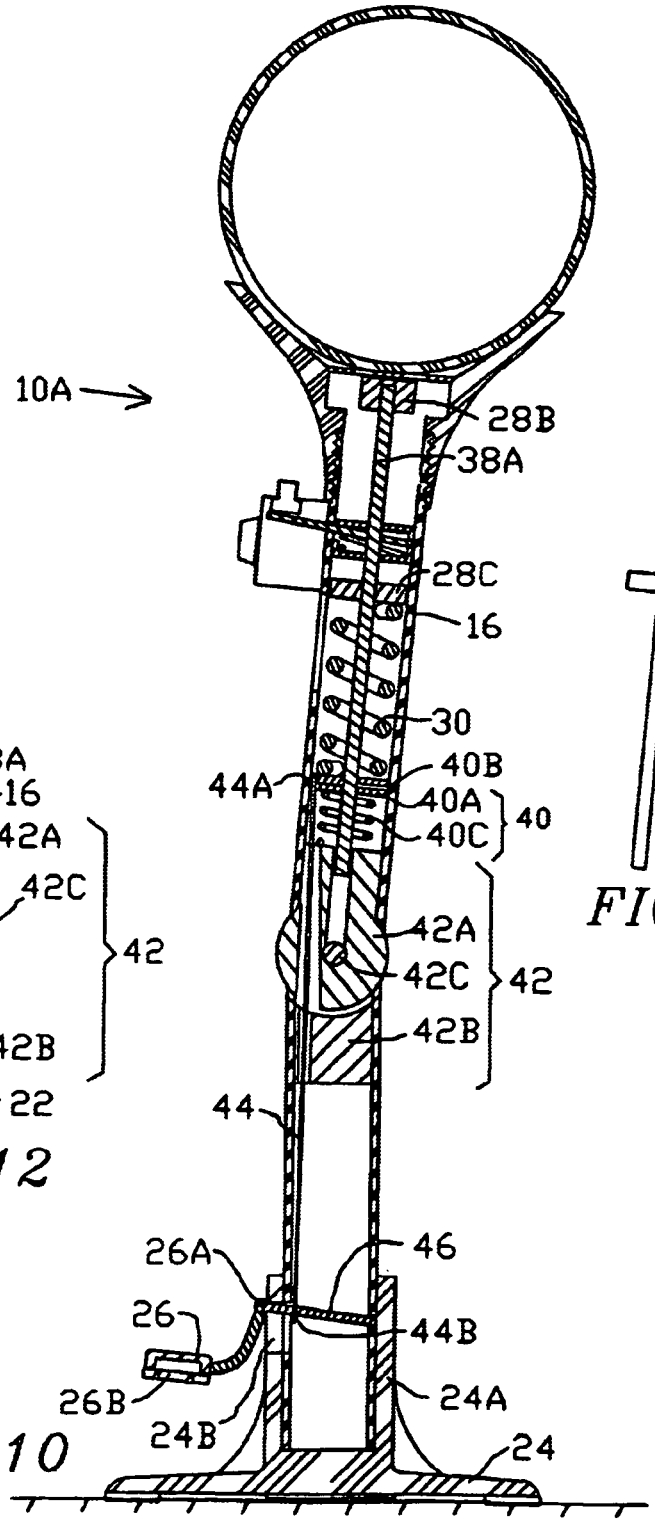
FIG. 10 is a cross-section of a launcher with the external appearance of FIGS. 1–3, but containing alternative internal implementation.

FIG. 10 is a cross-sectional view taken through the center of a launcher 10A which, while virtually identical in external appearance and in functional operation to launcher 10 (FIGS. 1–9) is implemented differently internally.

Figure 11:
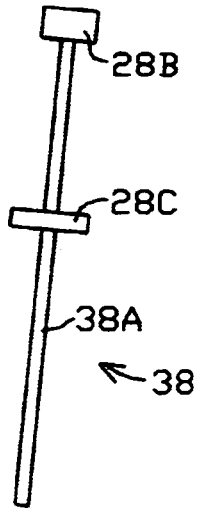
FIG. 11 is a side view of the plunger core assembly of the launcher of FIG. 10.

As shown separately in the side view of FIG. 11, plunger core assembly 38 utilizes only a single rod 38A, fitted with striker head 28B and collar 28C, similar to the upper rod portion in launcher 10, but no longer requiring the connector link 28D (FIGS. 4–9) and the associated rod fastenings at both ends. In launcher 10A (FIG. 10), a pump grip module 40, functionally equivalent to pump grip module 34 (FIGS. 4–9) is located inside tubular member 16, immediately above the hinge joint 42. Pump grip plate 40A, engaging rod 38A directly, is urged upwardly against the horizontal bottom surface of collar 40B by pump grip spring 40C, which is supported on hinge portion 42A. Collar 40B, securely fastened to upper tubular portion 16, provides the bottom end support of main spring 30.

Pump grip plate 40A is actuated by a connector link 44 which is driven by a lever system at the bottom including treadle 26 connected by hinge 26A to a pump lever arm 46 whose right hand end is pivoted to the right hand side of lower tubular portion 22 and base hub 24A by a hinge or fulcrum constraint. This arrangement provides leverage gain at the treadle 26, and thus can br designed to operate at reduced pumping force and increased length of vertical pump stroke compared to the direct pump drive in launcher 10.

Figure 12:
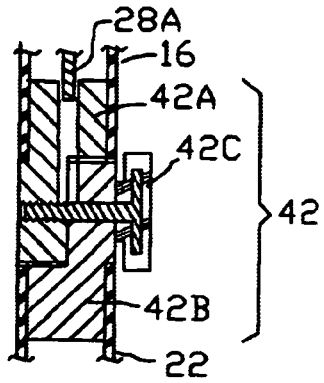
FIG. 12 a cross-section of the hinge joint portion of the launcher of FIG. 10 taken in a perpendicular plane.

FIG. 12, corresponding to FIG. 6, is a cross-section of the region of hinge joint 42 of FIG. 10, taken through a central plane that is perpendicular to that of FIG. 10, as viewed from the left hand side of FIG. 10. The upper hinge portion 20A and lower hinge portion 20B are seen to be generally symmetrical in outline. The threaded shaft of knob 42C traverses a clearance hole in lower portion 42B and engages a threaded hole in upper portion 42A, providing the same adjustment capability as in the previously described hinge joint (20, FIGS. 3,4) for setting the upper tubular portion 16 at a desired inclination from the vertical lower tubular portion 22 to obtain a desired trajectory of a launched ball 12.

Apart from the differences described above, the remaining structure of launcher 10A and the loading and launching procedure are essentially the same as described above in connection with the first implementation: launcher 10 (FIGS. 2–7). As in launcher 10, plunger core rod 38A is typically made from stainless steel 5/16" in diameter and connection link 44 is preferably made from stainless steel cable about ⅛ inch in diameter, but could be made from steel wire.

Figure 13:
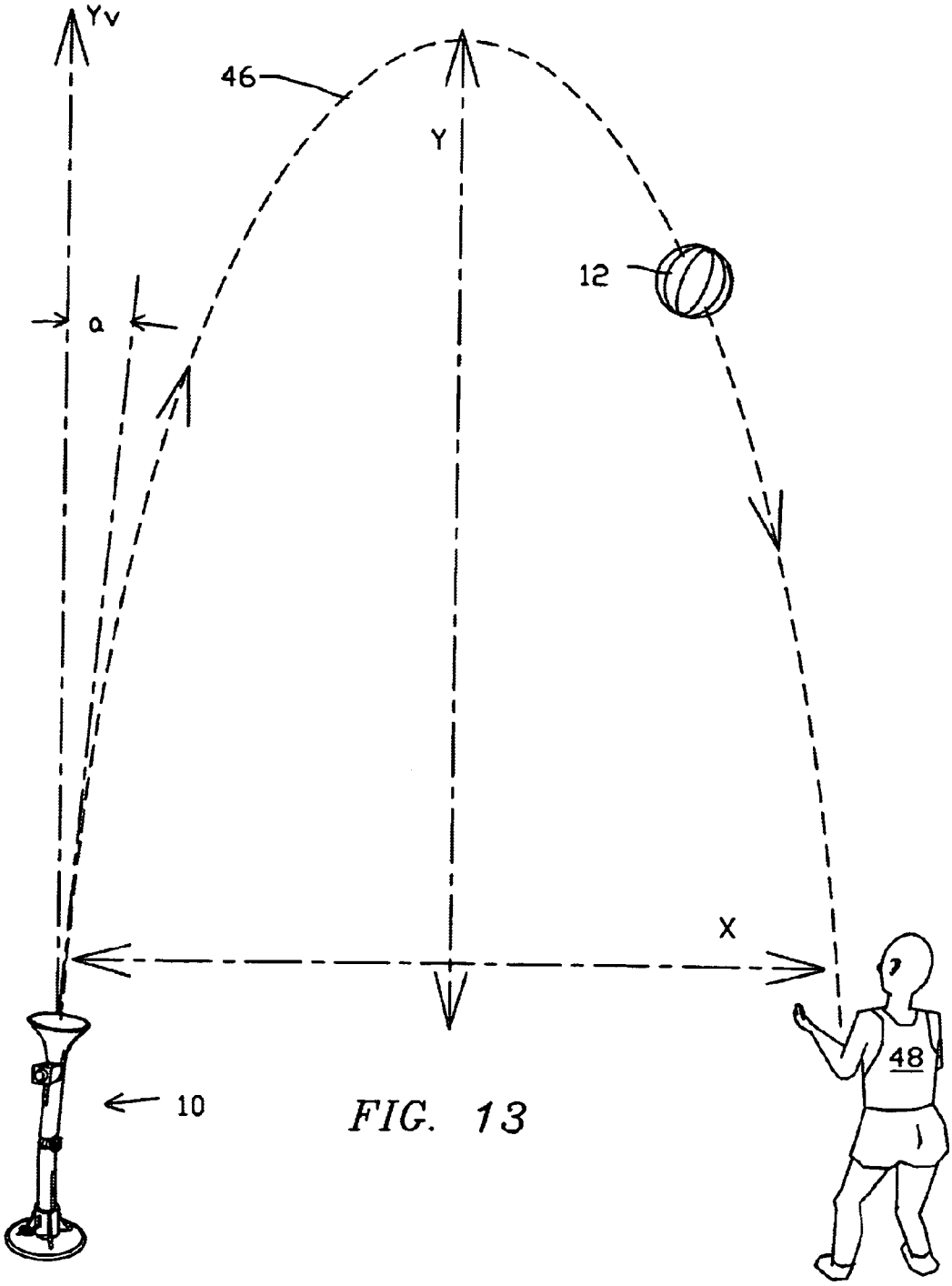
FIG. 13 depicts the trajectory of a launched ball.

FIG. 13 depicts the trajectory 46 of a ball 12 launched by launcher 10. Yv represents the maximum height that ball 12 would reach, as determined by the loaded spring force, with the hinge joint set for zero inclination to launch ball 12 straight up in purely vertical direction.

Path 46 represents the parabolic trajectory of ball 12 when launched at an angle a of inclination from vertical, 5 degrees as shown, and Y represents the maximum height of path 46.

In the following calculations, the effect of air friction on the ball is neglected as negligible, apart from the potential influence of wind.

For simplification, instead of referencing to ground level, calculations are referred to the elevation at the top end of the launcher 10, typically 4 to 5 feet above ground which is about shoulder-level of player 48. Thus, for Y=30 feet, the actual height would be 34 to 35 feet above ground level.

The reduced height due to inclination Y/Yv can be calculated from Yv*cos(a), this relatively small: about 3.5% for a=15 degrees and proportionately less for smaller angles.

It is of particular interest to the user to be able to estimate the horizontal distance X of the ball landing point from the launcher 10 as a function of maximum height Yv. This can be estimated from X=4*Yv*sin(a): thus for Yv=30 feet and a=5 degrees, X=10.46 ft., a reasonable working distance.

The airborne time period can be found from the calculus-derived basic rule of gravity for a falling body, Y=−(g/2)*t^2 =−16*t^2, the one-way time, which is the same for the up path as for the down path, can be calculated as t=(Y/16)^−2: for this example t=1.37 seconds, thus the total airborne time is 2*t=2.74 seconds.

The horizontal velocity can be calculated by first calculating the "muzzle velocity" from Vm=g*t: for this example 32*1.37=43.84 ft/sec i.e. 29.88 mph, from which the horizontal velocity can be calculated: Vh=Vm*sin(a), i.e. Vh=3.82 ft/sec (2.6 mph) for this example.

This indicates that the influence of wind must be considered mind since a 3 mph wind is roughly equivalent to a 5 degree inclination, and could substantially double or nullify the effect of the 5 degree inclination, depending on the wind direction.

In the above described implementations, the friction gripping principle for driving a rod, including a pump module and a hold/release module, each utilizing a tilted grip plate with a central binding hole and typically spring-loaded, is known and used in common apparatus such as caulking guns for its ability to drive a rod longitudinally with a pumping action in a simple and economical manner. Also a similar form of hold/release module is utilized as an adjustable stop that fits onto a pipe member of a utility clamp system. It is well known that this principle of positively re-enforced frictional uni-directional binding action can be utilized with many different locations and arrangements of the two modules anywhere along a working region of the rod as alternatives to the particular locations and arrangements described above and shown in the drawings.

Unidirectional drive functions for pumping and hold/release can also be accomplished by application of principles other than frictional binding, through the use of standard mechanical apparatus such as ratchet gears with spring-loaded pawls, rack-and-pinion arrangements, and the like, however such implementation would tend to be substantially more costly.

As an option, the invention could be practiced in simplified manually-launched embodiment wherein timer 24 is omitted and launching is initiated by simply depressing an extending portion of the grip plate of the hold/release module as the manual launching control.

An electrical actuator coupled to the extending release arm of grip plate 34A would open the possibility of utilizing wired or wireless remote control, with or without the provision of a timer.

As an alternative to a mechanical timer, electrical implementation would work in conjunction with an electrical actuator and could indicate delay time on a numeric readout. Alternatively the time delay could provided by other methods such as hydraulic or pneumatic.

As an alternative or supplement to spring 32, motive force for launching could be provided pneumatically, hydraulically or electrically by adapting known technology. Thus the need for manual pumping could be eliminated or minimized, and other methods of adjusting the force and resulting ball height would be facilitated.

As an alternative to loading by foot-operated treadle as described above, a hand-operated pump could be provided to operate in a similar manner: a pump handle could be mounted at a convenient height at a chosen location on the tubular body of the launcher and coupled directly, or by internal or external linkage to the pump grip module.

As alternatives to hinge joints 20 or 42 as shown above, a locking or high friction ball joint could be employed, or a "gooseneck" arrangement with stiffly flexible corrugated tubular construction for at least some portion of the main tubular body.

There are additional variations utilizing hand, foot or powered loading with which the invention may be practiced.

Instead of utilizing the compressed condition of the coil spring to store energy for launching, the stretched condition could be utilized, either with a coil spring or other commercially available stretch cord.

The invention may be embodied and practiced in other specific forms without departing from the spirit and essential characteristics thereof. The present embodiments are therefore to be considered in all respects as illustrative and not restrictive, the scope of the invention being indicated by the appended claims rather than by the foregoing description; and all variations, substitutions and changes which come within the meaning and range of equivalency of the claims are therefore intended to be embraced therein.

What is claimed is:

1. A launcher for an inflated sports ball for practice activities including face-off jumps and catches, comprising:

a ball holder configured in a bowl shape with an upwardly facing concentric recess shaped to support a sports ball;

an elongate main body structure oriented in a substantially vertical direction, made and arranged to support said ball holder at an upper end thereof, and configured at a lower end thereof with a base made and arranged to provide stable support from a horizontal ground region:

a plunger core assembly including an elongated primary plunger core rod;

a strike head firmly affixed to an upper end of said plunger core rod in said support structure beneath the ball holder, constrained and guided by said vertical support structure in a manner to allow said plunger core assembly to travel only in a substantially longitudinal direction;

a friction binding actuator mechanism located in said support structure, associated with said plunger core assembly, made and arranged to respond to actuation of a launch command by a user by releasing said plunger core assembly to travel upwardly until impact from the strike head transfers energy to the ball, launching the ball into air space above for sports practice purposes; and a source of stored energy to be utilized to drive said plunger core assembly for launching.

2. The sports ball launcher as defined in claim 1 wherein said source of stored energy comprises:

energy storage means for temporarily storing mechanical energy for a subsequent launching;

loading means for inputting and thus loading said energy storage means up to a desired level of stored energy within a predetermined maximum capability; and hold/release means made and arranged to cause said energy storage means to retain the stored energy in a default mode, to accept and accumulate further input of energy up to the predetermined maximum capability in a loading mode, and, in response to user launch actuation, to transfer the stored energy to said plunger core assembly as kinetic energy in upward movement thereof, to be further imparted to the ball, on impact from said strike head, as upward travel thereof.

3. The sports ball launcher as defined in claim 2 wherein said energy storage means comprises:

a coil spring having a nominal unstressed length, made and arranged to store potential mechanical energy in response to a forced and constrained change in length from the nominal unstressed length.

4. The sports ball launcher as defined in claim 3 wherein said loading means comprises:

a reciprocating pump mechanism made and arranged to be operable by a user in a manner to apply a progressive change in length to said main coil spring and thus an increase of potential mechanical energy stored therein.

5. The sports ball launcher as defined in claim 4 wherein:

said main coil spring is constrained at one end thereof to said main body and acted upon at an opposite end by mechanical structure of said plunger core assembly made and arranged to cause downward displacement of said plunger core rod to bias said coil spring by altering its length from the nominal unstressed length, thus storing potential mechanical energy that can subsequently be released and utilized to move the plunger core rod upwardly for launching purposes;

said hold/release means comprises a uni-directional grip mechanism made and arranged to allow downward displacement of said plunger core rod but to prevent any upward displacement of said plunger core by a positively re-enforced frictional binding action that can be released only by user launch actuation; and a release sub-mechanism in said uni-directional grip mechanism including a release lever arm made and arranged to respond to launch actuation by discontinuing the positively re-enforced binding action of said uni-directional grip mechanism and thus permitting upward displacement of said plunger core for purposes of launching the ball.

6. The sports ball launcher as defined in claim 5 wherein:

said main body comprises an upper tubular portion attached to said ball holder and a lower tubular portion attached to said base, the two tubular portions being connected together in a mid region by a hinged joint having two joint portions made and arranged to enable a user to set a desired angle of inclination between the two tubular portions and to secure the two joint portions together in a manner to hold a set angle of inclination reliably constant for subsequent ball launchings;

said main coil spring is enclosed within the upper tubular portion of the main body, and is supported at a lower end by structure securely attached to the upper tubular portion; and said primary plunger core assembly is disposed in coaxial relationship with said main coil spring, extending through said main coil and beyond the upper and lower ends thereof.

7. The sports ball launcher as defined in claim 6 further comprising:

an annular coil drive collar, securely attached to said plunger core rod, made and arranged to exert downward force on the upper end of said main coil spring and thus compress the main coil spring when said plunger core rod is driven downwardly;

a unidirectional hold/release gripping module securely fastened within the upper tubular portion of the main body, configured with a central opening traversed by said plunger core rod and having a release-actuating arm extending through an opening in the upper tubular portion, made and arranged to act on said plunger core rod in a manner to permit downward travel thereof but to prevent upward travel thereof until released by actuation of the release-actuating arm for launching purposes;

a loading system made and arranged to pull said plunger rod assembly downward and thus cause said coil drive collar to compress said main spring to a desired energy level which is to be maintained by said unidirectional hold/release gripping module until released by actuation of the release-actuating arm to initiate a launching; and a low end journal, surrounding a lower region of said plunger core rod, made and arranged to allow longitudinal travel of said plunger core rod and thus said plunger core assembly, over a predetermined launch stroke range, while guiding and constraining the lower end of said plunger core rod laterally.

8. The sports ball launcher as defined in claim 7 wherein said loading system is implemented as a foot pump comprising:

a treadle pad made and arranged to receive depression from a foot of the user in a reciprocating pumping action having a designated vertical pump stroke length; and a uni-directional pump gripper, operationally connected to said treadle pad, made and arranged to engage and drive said plunger core rod in manner to move said plunger core downward on downward pump strokes, while allowing said plunger core to remain held stationary by said unidirectional hold/release gripping module during upward pump strokes, such that repeated cycles of downward and upward pump strokes cause increasing downward travel of said plunger core assembly and consequent increasing compression of said main spring, until a desired degree of loading has been accomplished.

9. The sports ball launcher as defined in claim 8 further comprising:

a loading gage made and arranged to provide a visual showing of amount of energy stored in said main spring available for a subsequent launching, relative to maximum capability.

10. The sports ball launcher as defined in claim 9 wherein said loading gage comprises:

a distinctive marking on a circumferential region of said coil drive collar; and said upper tubular portion being configured with a vertical slot extending to travel range limits of said coil drive collar, made and arranged to display said distinctive marking in a manner to be conveniently visible by the user as an indication of relative loading.

11. The sports ball launcher as defined in claim 8 further comprising:

in said plunger core assembly (a) a secondary elongate metal plunger core rod, located on a central axis within a lower region of said lower tubular portion of said main body, constrained and guided laterally but having a vertical travel range at least equal to that of said primary plunger core rod; and (b) a plunger core connector link having an upper end attached to the lower end of said primary plunger core rod and having a lower end attached to the upper end of said secondary plunger core rod, the connector link being made and arranged to transmit downward displacement of said secondary plunger core to said primary plunger core for purposes of compressively loading said main coil spring; and said uni-directional pump gripper being located within said lower tubular portion, made and arranged to operationally act upon said secondary plunger core rod in response to reciprocating pumping action applied to said treadle pad by the user for purposes of compressively loading said main coil spring.

12. The sports ball launcher as defined in claim 8 wherein:

said uni-directional pump gripper is located within said upper tubular portion surrounding a lower end region of said primary plunger core rod; and said ball launcher further comprises a pump connector link having a lower end operationally connected to said treadle pad and an upper end operationally connected to a grip plate of said uni-directional pump gripper, the pump connector link being made and arranged to transmit downward displacement of said treadle pad to the grip plate of said uni-directional pump gripper for purposes of compressively loading said main coil spring in response to foot-pumping actuation of said treadle pad by the user.

13. The sports ball launcher as defined in claim 8 further comprising:

a pump lever arm, carrying at an end thereof said treadle pad, made and arranged to operationally connect said treadle pad to said uni-directional pump gripper; and a hinge joint, configured in said pump lever arm, made and arranged to enable normal pumping usage of said treadle pad and also, for purposes of safety when in a standby mode to allow said treadle pad along with a portion of said lever arm to be folded upwardly so as to place said treadle pad adjacent to said lower tubular portion of said main body.

14. The sports ball launcher as defined in claim 1 further comprising:

a timer made and arranged to introduce a user-selectable time delay, initiated by the user launch command actuation, and, at the end of the time delay, to release said plunger core assembly to be driven upwardly so as to launch the ball, the time delay serving to allow the user to initiate actuation then move into place and become ready for ball retrieval activity upon the delayed actual launching.

15. The sports ball launcher as defined in claim 1 further comprising:

an inclination-setting mechanism made and arranged to enable a user to make an adjustment of said main body in a manner select a direction for launching within a predetermined range that extends from vertical to a predetermined maximum angle of inclination from vertical.

16. The sports ball launcher as defined in claim 15 wherein said inclination-setting mechanism comprises:

a swivel joint assembly interposed between two portions of said main body, having two joint portions interconnected in a manner to enable the user to set the two portions of the main body to a desired angle of inclination there between; and retaining means for holding a set angle of inclination reliably constant for subsequent ball launchings.

17. The sports ball launcher as defined in claim 16 wherein:

the two joint portions are configured function as a hinge joint, interfacing in a flat, vertical and generally circular region traversed by a central hinge axis, the two joint portions being hinged together by a hinge bolt, disposed in a cylindrical opening on the central hinge axis of each joint portion, and threadedly engaged with one of the joint portions; and said retaining means comprises a user knob integrally secured to the hinge bolt, made and arranged to threadedly lock the two joint portions securely together when rotationally tightened by the user subsequent to setting a desired angle of inclination, so as to reliably hold a set angle of inclination constant for subsequent ball launchings.

18. The sports ball launcher as defined in claim 17 further comprising an inclination gage having a pointer member affixed to one of the two portions of said main body, and a scale calibrated in degrees affixed to the other of the two portions of said main body, said inclination gage being made and arranged to indicate degrees of inclination between the two portions of said main body.

19. The sports ball launcher as defined in claim 18 wherein said swivel joint assembly comprises, as the two joint portions, a ball portion and a socket portion 1, thus enabling adjustment of inclination in any radial direction relative to said main body.

20. The sports ball launcher as defined in claim 1 wherein said ball-holder is configured with a resilient membrane extending over a circular central region thereof made and arranged to transmit drive force from the strike head for ball-launching while protecting the ball against damage.

* * * * *